United States Patent [19]

Anselmo

[11] 4,044,462

[45] Aug. 30, 1977

[54] RIVET BLANK FEEDER FOR RIVETING APPARATUS

[75] Inventor: Dario Anselmo, Williamsville, N.Y.

[73] Assignee: General-Electro Mechanical Corporation, Buffalo, N.Y.

[21] Appl. No.: 735,389

[22] Filed: Oct. 26, 1976

[51] Int. Cl.[2] ..... B23Q 7/10

[52] U.S. Cl. ..... 29/809; 29/243.53; 29/281.1; 198/488; 214/1 BC

[58] Field of Search ..... 29/211 D, 211 R, 526, 29/208 R, 208 D, 200 B, 243.5 B, 809, 281.1; 214/1 BB, 1 BC; 227/117, 118, 137; 198/488

[56] References Cited

U.S. PATENT DOCUMENTS

| | | | |
|---|---|---|---|
| 2,244,595 | 6/1941 | Amiot | 227/149 X |
| 2,306,851 | 12/1942 | Ward | 29/211 D |
| 2,974,811 | 3/1961 | Dammert et al. | 214/1 BC |
| 3,587,872 | 6/1971 | Pauly | 214/1 BC |
| 3,747,193 | 7/1973 | Gregory | 29/243.53 |
| 3,766,627 | 10/1973 | Headman | 29/208 D X |
| 3,824,833 | 7/1974 | Bachmann | 214/1 BC X |
| 3,851,769 | 12/1974 | Noguchi et al. | 214/1 BC |

*Primary Examiner*—Victor A. DiPalma
*Attorney, Agent, or Firm*—Christel & Bean

[57] ABSTRACT

The present apparatus transfers cylindrical rivet slugs or blanks from a supply point to an annular elastomeric holder which is coaxial with and associated with rivet head forming means. The apparatus comprises a fluid pressure power cylinder having a piston rod projecting therefrom and a transfer arm fixed to the piston rod. The power cylinder operates to raise and lower the transfer arm and means are provided for swinging the transfer arm horizontally between positions in axial alignment with the rivet slug supply means and the rivet head forming means. The transfer arm receives a rivet slug at the supply means, lowers by operation of the power cylinder, swings to axial alignment with the rivet head forming means, and raises to insert the rivet slug in the elastomeric annular holder. The movements are then reversed to return the transfer arm to the starting position.

7 Claims, 4 Drawing Figures

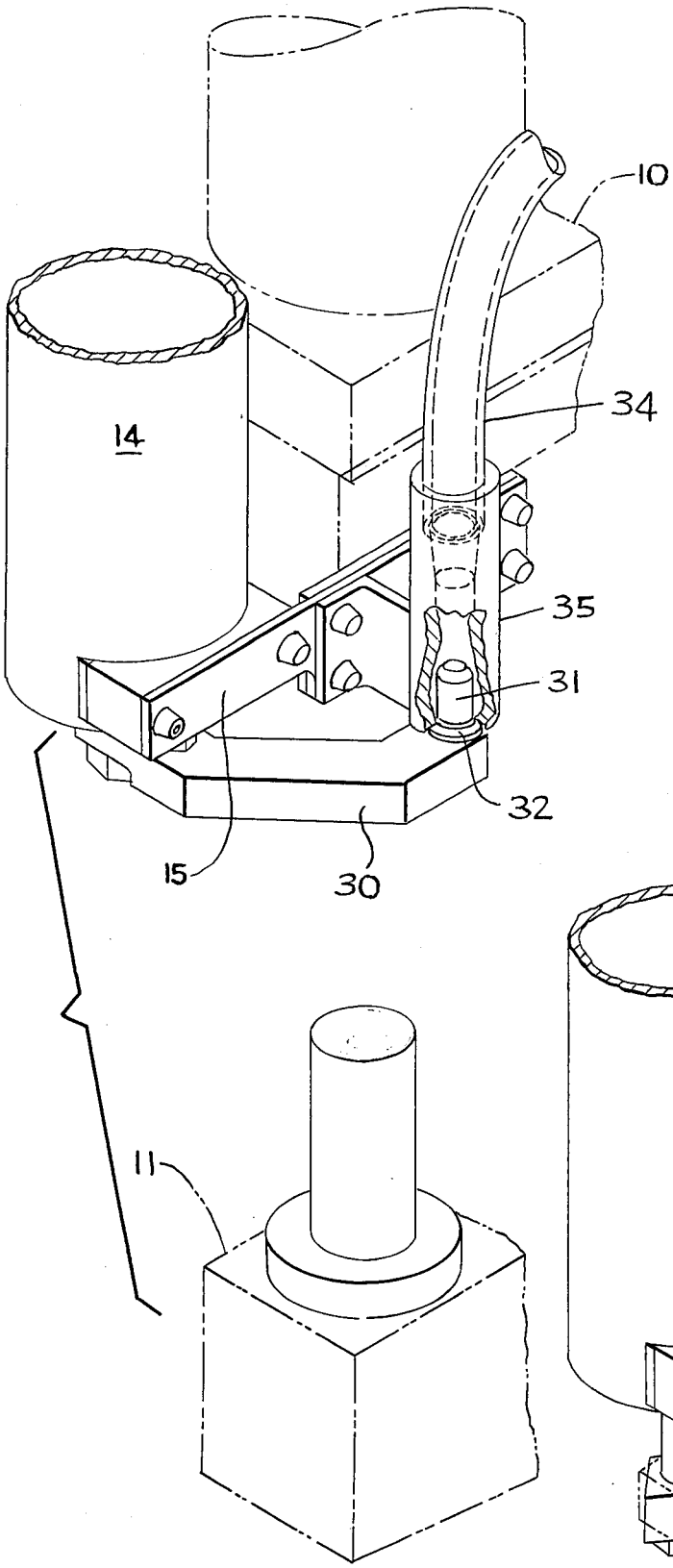
FIG. 1.
FIG. 2.
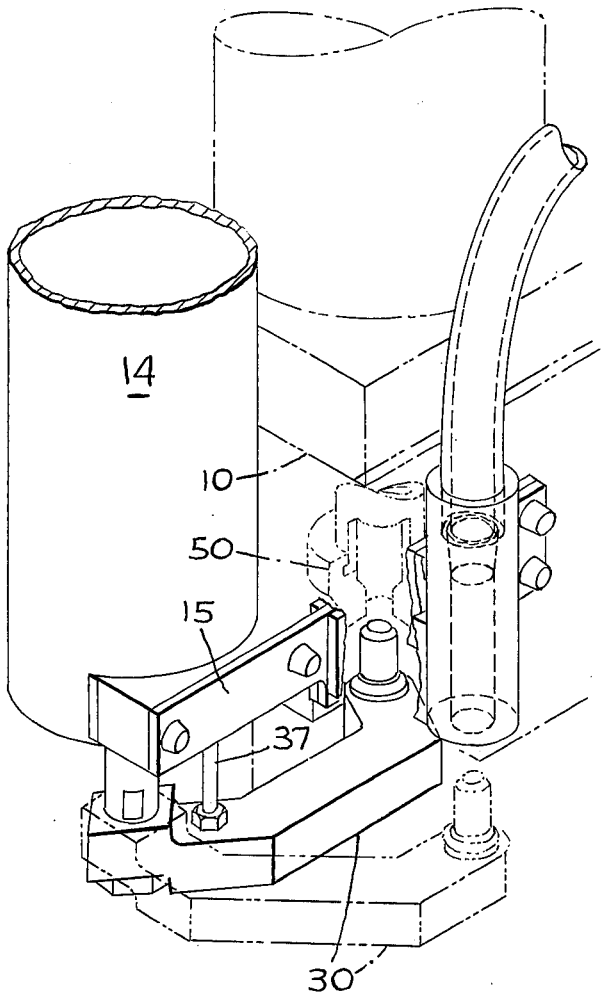

RIVET BLANK FEEDER FOR RIVETING APPARATUS

BACKGROUND OF THE INVENTION

This invention relates to mechanism for introducing rivet blanks to riveting mechanism. In the riveting art slug riveting is the term used to describe a riveting method wherein unheaded cylindrical blanks are inserted in work pieces and wherein heads are then formed at opposite ends of the rivet blank or slug.

The problem of providing slugs of this kind and introducing them to the riveting mechanism in proper position and for inserting them in work pieces has presented certain problems.

In some mechanisms the operation of introducing and inserting the rivet blank is by moving the same directly downwardly along the riveting axis but this necessitates a lateral movement of the upper riveting mechanism itself to clear the way for insertion of the blank and thus complicates the riveting machine structure and makes it more difficult to maintain axial alignment. In other proposals the rivet blank is introduced laterally between the riveting means and is held by the rivet feeding device until the riveting parts move toward each other relatively in a rivet head forming operation. This method is not entirely satisfactory and presents problems in the proper insertion of the rivet blank in the work prior to the actual head forming operation.

SUMMARY OF THE INVENTION

In the rivet feeding and inserting mechanism of the present invention successive rivet blanks are moved laterally into axial alignment with the rivet forming anvils and are thence moved axially into engagement with a resilient rivet blank holder which is associated with one of the rivet head forming anvils. The resilient blank holder and the manner in which it cooperates with the riveting mechanism in the insertion of a rivet blank into the work piece in position for rivet head forming is shown and described in detail in a copending application of Joseph Vargo, Jr. and John W. Davern filed concurrently herewith, Ser. No. 735,388, and is described herein only in sufficiently general terms for a full understanding of the present invention.

BRIEF DESCRIPTION OF THE DRAWINGS

FIG. 1 is a fragmentary perspective view of one form of the rivet inserting mechanism of the present invention;

FIG. 2 is a view similar to FIG. 1 but showing only the upper arm and with the rivet inserting parts in a more advanced position of operation;

DESCRIPTION OF THE ILLUSTRATED EMBODIMENT

Speaking generally, riveting apparatus of the type under consideration comprises upper and lower arms which receive work pieces therebetween and which are provided with rivet head forming anvils for forming rivet heads at the opposite ends of a generally cylindrical rivet slug which is inserted in the work pieces. In FIGS. 1 and 2 the aforesaid upper and lower arms are indicated fragmentarily and designated, respectively, 10 and 11. A representative slug riveting apparatus of the prior art will be found in Speller U.S. Pat. No. 3,557,442 dated Jan. 26, 1971.

In the apparatus and method of the present invention cylindrical blanks or slugs are introduced to the riveting apparatus by moving such slugs into vertical axial alignment with the riveting instrumentalities beneath the upper rivet head forming means and then moving such blanks upwardly into means for engaging the same in conjunction with the upper rivet head forming anvil. The means for receiving and retaining the rivet blank or slug may be of the type fully shown and described in a copending application of Joseph Vargo, Jr. and John W. Davern, Ser. No. 735,388. In the riveting mechanism of said application an elastomeric annular rivet blank holder is provided with a central bore slightly smaller than the diameter of a rivet blank so that the latter may be projected upwardly into the holder and retained therein pending the insertion of the blank in the work and the ensuing rivet head operation.

Figure 4:
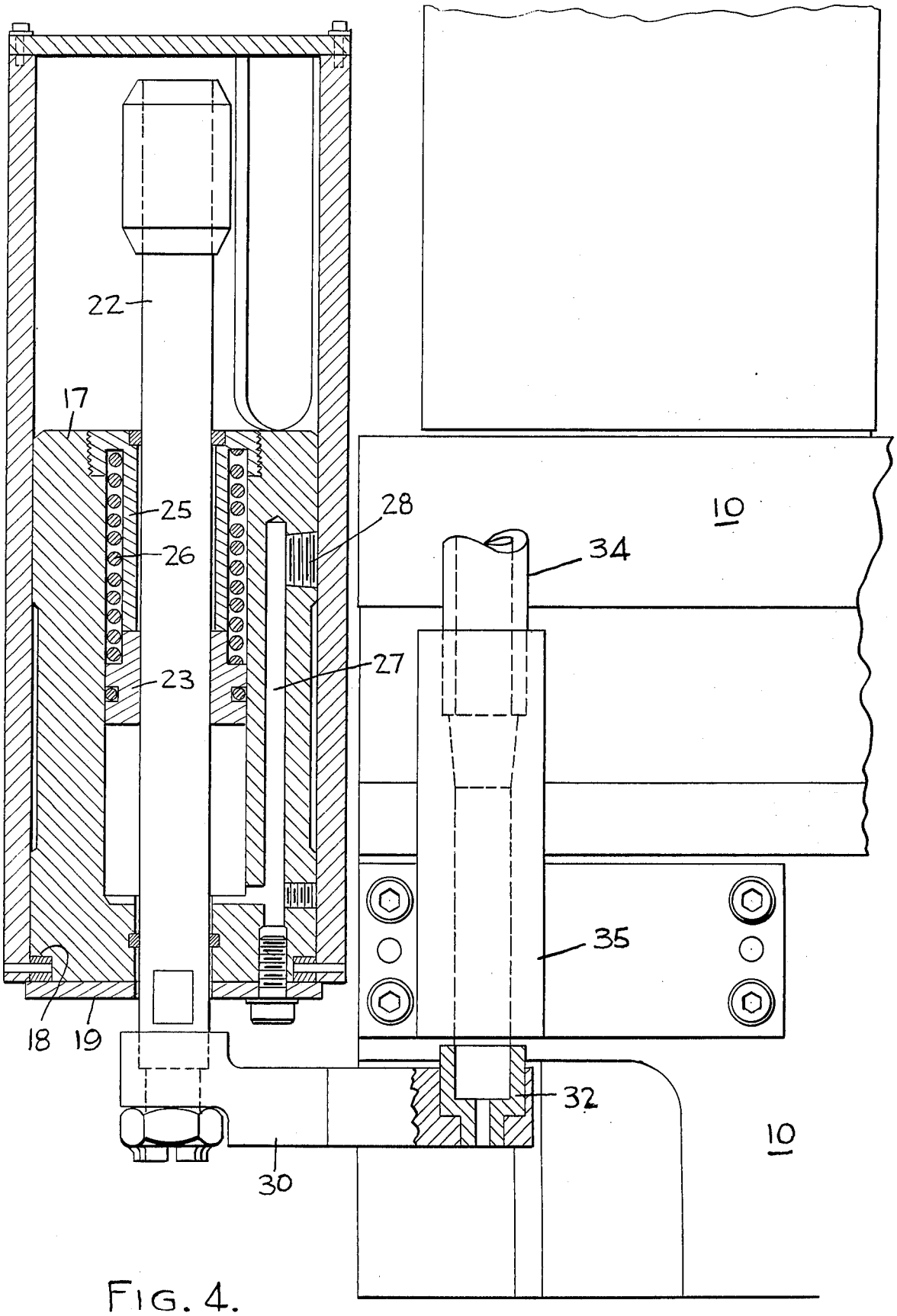
FIG. 4 is a cross-sectional view on a vertical plane through the structure of FIG. 3.

In the drawings, as best shown in FIGS. 1 and 2, the numeral 14 designates an upright cylindrical housing which is attached to the upper arm 10 of the riveting mechanism by a bracket 15. Referring particularly to FIG. 4, an air cylinder 17 is contained within housing 14 and is free to rotate therein but is retained against relative axial movement in the housing. To this end the lower end of cylinder 17 is provided with an annular external groove which receives a ring 18 which is pinned to housing 14 as shown in FIG. 4 but is free to rotate in the annular groove of cylinder 17. A bottom plate 19 is fixed to the lower end of cylinder 17 and bears against ring 18 to prevent relative upward movement of cylinder 17 in housing 14 while permitting free rotation of the cylinder in housing 14.

In FIG. 4 the numeral 22 designates a piston rod having a piston 23 fixed thereto. In FIG. 4 piston 23 is shown in abutment with a bushing 25 which is threaded into cylinder 17, thus establishing the upper limit of movement of piston rod 22.

A pre-loaded compression coil spring 26 acts between piston 23 and a flange at the upper end of bushing 25 normally urging piston rod 22 downwardly. In the position of parts illustrated in FIG. 4 air pressure within cylinder 17 beneath piston 23 has moved piston 23 to its illustrated upper limit position. Air pressure for energizing the lower end of cylinder 17 is provided by way of passage 27 and an air pressure connection (not shown) is provided at the tapped hole illustrated at 28 in FIG. 4. Passage 27 and tapped hole 28 are actually angularly displaced from the position shown in FIG. 4 so that the connection therewith does not interfere with upper arm 10 of the riveting mechanism. Also, a clearance opening (not shown) is provided in the wall of housing 14 to permit connection of the air supply with tapped hole 28 and this clearance opening is sufficiently large to permit rotation of cylinder 17 in housing 14 for purposes which will presently appear.

A rivet blank or slug transfer arm 30 is fixed to the lower end of piston rod 22 and in the position illustrated in FIGS. 1 and 4 is adapted to receive a rivet blank or slug 31 in a rivet blank receiving cup 32. The rivet blanks 31 are fed to rivet cup 32 downwardly through a flexible tube 34 which terminates in a nipple fitting 35. The means for feeding successive rivet blanks or slugs to the rivet cup 32 of transfer arm 30 is by successive applications of air pressure downwardly through tube 34 but forms no part of the present invention and will not be further described herein.

As best shown in FIG. 2 a generally vertical rod 37 is fixed at its lower end to transfer arm 30 at a point spaced from the axis of piston rod 22 and extends upwardly through plate 19 at the lower end of cylinder 17 and is disposed for vertical sliding movement in a registering opening in cylinder 17. Rod 37 thus permits free relative vertical movement as between transfer arm 30 and cylinder 17 but provides for joint angular movement of cylinder 17, piston rod 22 and transfer arm 30.

Figure 3:
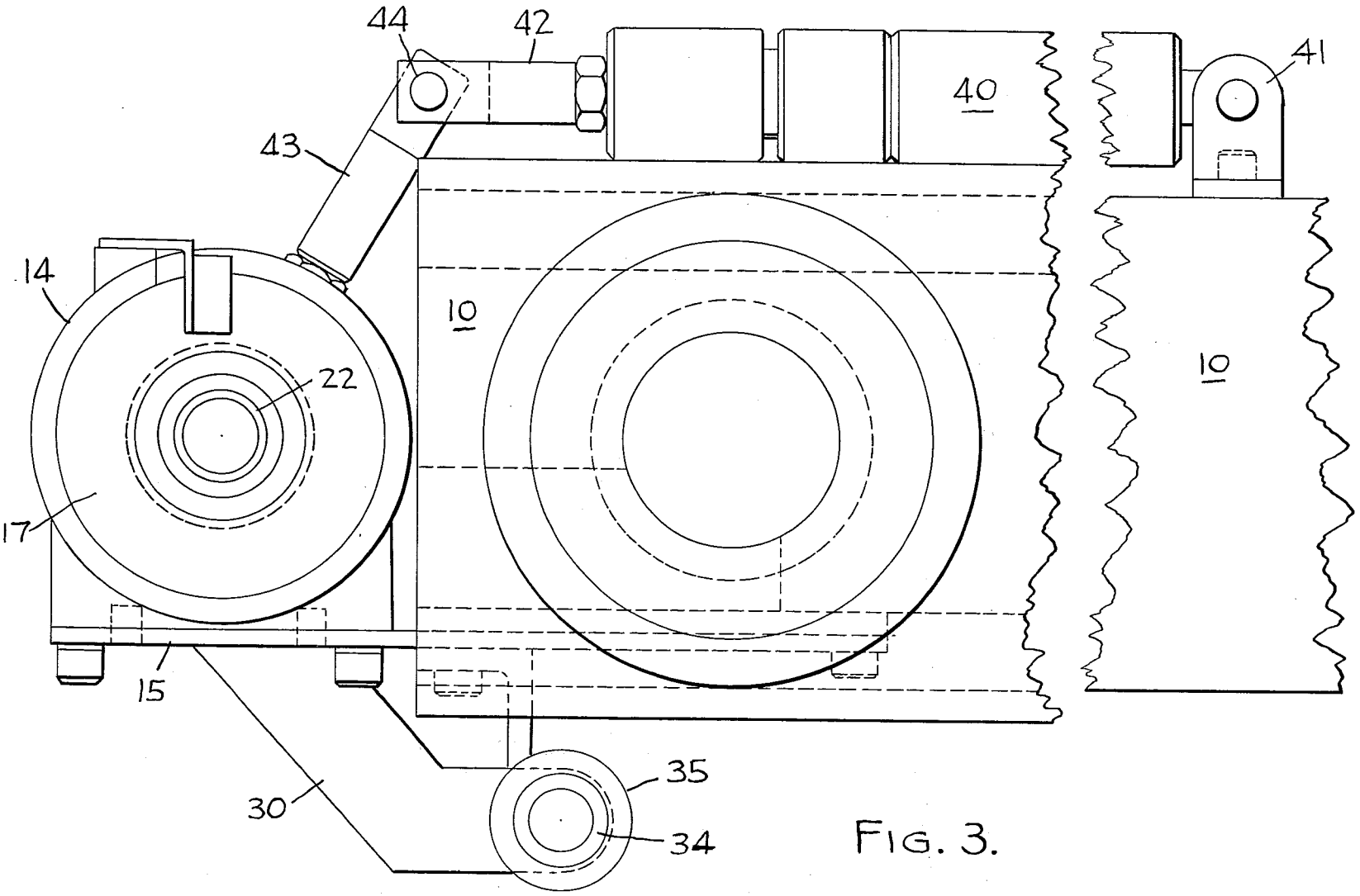
FIG. 3 is a top plan view of the structure of FIG. 1.

Angular movements of cylinder 17, piston rod 22 and transfer arm 30 are effected by means best shown in FIG. 3 comprising a power cylinder 40 pivoted at one to a bracket 41 fixed to upper arm 10 and having a piston rod 42 projecting from the opposite end thereof. Piston rod 42 is pivoted at its outer end to the end of an arm 43 as at 44. Arm 43 extends rigidly from cylinder 17 through a suitable clearance opening (not shown) in the adjacent wall of housing 14. Thus, power movements of piston rod 42 in opposite directions reciprocate cylinder 17 angularly and thus effect arcuate movements of transfer arm 30 between the position illustrated in FIg. 3 and a position wherein the rivet slug receiving cup 32 is in axial alignment with the riveting anvils as shown in full lines in FIG. 2.

It is believed that the operation of the rivet slug inserting mechanism of the present invention will be clear from the foregoing description taken in conjunction with the drawings. Beginning with the parts in the positions illustrated in FIGS. 1 and 4 with air pressure applied in cylinder 17 beneath piston 23 to hold transfer arm 30 in its uppermost position, a rivet slug 31 is inserted in the rivet cup 32 as previously described herein. At this point, air pressure beneath piston 23 is cut off and coil spring 26 moves piston rod 22 and transfer arm 30 downwardly to the dot and dash position illustrated in FIG. 2.

Thereupon power cylinder 40 is activated to pivot arm 43 in a counter-clockwise direction as viewed in FIG. 3 to rotate cylinder 17 and piston rod 22 angularly to move the rivet slug transfer arm 30 to the full line position illustrated in FIG. 2. At this point air pressure is reapplied to cylinder 17 beneath piston 23 to move piston rod 22 and transfer arm 30 upwardly and thus insert the rivet slug into the resilient slug holding means indicated generally at 50 in FIG. 2 and described in complete detail in the aforesaid copending application of Joseph Vargo, Jr. and John W. Davern, Ser. No. 735,388. Thereupon the movement of the parts is reversed so that the transfer arm 30 moves downwardly, swings outwardly to the dot and dash line position of FIG. 2, and thence moves upwardly to the rivet slug receiving position of FIG. 1.

A preferred embodiment of this invention having been hereinabove described and illustrated in the drawings, it is to be understood that numerous modifications thereof can be made without departing from the broad spirit and scope of this invention as defined in the appended claims.

I claim:

1. Apparatus for inserting rivet slugs in an annular holder associated with rivet head forming means, said apparatus comprising a fluid pressure power cylinder, a piston in said cylinder and a piston rod projecting therefrom, a rivet slug transfer arm fixed to said piston rod, said power cylinder being operable to raise and lower said transfer arm by axial movements of said piston rod, and means for swinging said transfer arm about the axis of said cylinder between positions in axial alignment with a rivet slug supply means and said rivet head forming means with said transfer arm in a lowered position, whereby said transfer arm receives a rivet slug at said supply means, is lowered by operation of said power cylinder, swings to alignment with said rivet head forming means and is raised by operation of said power cylinder to insert said slug in said holder.

2. Apparatus according to claim 1 including a stationary cylindrical housing, said power cylinder being rotatably disposed in said housing, means retaining said power cylinder against axial movement, means engaging between said power cylinder and said piston rod for joint axial movement of said cylinder and piston rod, said transfer arm swinging means being connected with said power cylinder for jointly moving said cylinder, said piston rod and said transfer arm in angular directions.

3. Apparatus according to claim 2 including a power cylinder having a movable element thereof connected with said transfer arm swinging means for effecting said angular movements of said cylinder, piston rod and transfer arm.

4. Apparatus for inserting rivet slugs in an annular holder associated with rivet head forming means from rivet slug supply means spaced laterally with respect to the axis of said rivet head forming means, said apparatus including a rivet slug transfer member mounted for raising and lowering movements with respect to said supply means and said head forming means, and means for moving said transfer member horizontally between positions in axial alignment with said rivet slug supply means and said rivet head forming means with said transfer arm in lowered position, whereby said transfer member receives a slug at said supply means, is lowered with respect to said supply means, moves laterally to axial alignment with said rivet head forming means, and raises to insert said slug in said holder.

5. Apparatus according to claim 4 wherein said transfer member comprises an arm mounted for horizontal pivotal movement with slug receiving means adjacent to the outer end thereof.

6. Apparatus according to claim 4 wherein said annular holder comprises an elastomeric member adapted to elastically grip a slug inserted therein by upward movement of said transfer means.

7. Apparatus according to claim 5 wherein said annular holder comprises an elastomeric member adapted to elastically grip a slug inserted therein by upward movement of said transfer arm.

* * * * *

UNITED STATES PATENT AND TRADEMARK OFFICE

CERTIFICATE OF CORRECTION

PATENT NO. : 4,044,462

DATED : August 30, 1977

INVENTOR(S) : Dario Anselmo

It is certified that error appears in the above-identified patent and that said Letters Patent are hereby corrected as shown below:

Claim 4, line 11, "arm" should be --member--.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*